United States Patent [19]

Thomas et al.

[11] Patent Number: 4,789,111

[45] Date of Patent: Dec. 6, 1988

[54] DYE TUBE

[75] Inventors: Alvin D. Thomas, Valatie, N.Y.; Garner Pruitt, Greer, S.C.

[73] Assignee: Crellin, Inc., Chatham, N.Y.

[21] Appl. No.: 117,676

[22] Filed: Nov. 5, 1987

[51] Int. Cl.[4] ..... B65H 75/20

[52] U.S. Cl. ..... 242/118.1; 242/118.11; 242/118.3

[58] Field of Search ..... 242/118.1, 118.11, 118, 242/118.3, 118.31, 118.32, 118.2; 68/189, 198

[56] References Cited

U.S. PATENT DOCUMENTS

| | | | |
|---|---|---|---|
| 3,465,984 | 9/1969 | Tigges et al. | 242/118.11 |
| 3,647,156 | 3/1972 | Henning | 242/118.1 |
| 4,181,274 | 1/1980 | Burchette, Jr. | 242/118.11 |
| 4,702,433 | 10/1987 | Gilljam et al. | 242/118.1 |

*Primary Examiner*—Stanley N. Gilreath
*Attorney, Agent, or Firm*—Kane, Dalsimer, Sullivan, Kurucz, Levy, Eisele and Richard

[57] ABSTRACT

A dye tube has a pair of end rings and at least one support ring intermediate these rings and concentric therewith. A plurality of alternate, rigid V-shaped and inverted V-shaped ribs are integrally formed with the rings and defined therewith an initially rigid network of winding yarn to be dyed through which dye can flow. The ribs are arranged in separate spaced groups so as to tend to collapse axially in opposite directions upon the application of a predetermined force thereon. A non-collapsible torque resistant section extends from each end ring to strengthen the structure and prevent it from buckling.

5 Claims, 2 Drawing Sheets

DYE TUBE

BACKGROUND OF THE INVENTION

This invention relates to dye tube carriers for dyeing yarn wound thereon.

STATEMENT OF PRIOR ART

The art is already aware, inter alia, of the following U.S. Pat. Nos. 3,465,984; 4,181,274.

This background disclosure is restricted to those patents above listed, which are believed most relevant.

Very basic is U.S. Pat. No. 3,465,984 which discloses a lap carrier resiliently compressible in its axial direction and defining a surface area comprising end rings and intermediate rings. A number of carrier elements are disposed between these end rings and have outer edges oriented toward the surface area of the lap carrier, these carrier elements comprising elastically bendable stays equally distributed along the periphery of the lap carrier and inclined for at least a part of their length to the longitudinal axis of the lap carrier. These stays are rigidly secured to the rings.

U.S. Pat. No. 4,181,274 is relevant for describing a dye tube consisting of a molded tubular element that is initially rigid but which is capable of axial compression upon contact with a predetermined axial force. Structurally the reference dye tube comprises a pair of annular end flanges and an intermediate structure located between these annular flanges. The intermediate structure comprises at least one member extending generally transversely to the length of the tube and a plurality of rigid members extending generally axially with respect to the length of the tube. These members are secured together to initially define a rigid structure having an open network wherein at least certain rigid axially extending members are deformable upon urging by an axial force of a predetermined amount to cause axial compression of the tube. These tubes are made of various thermoplastic polymeric materials and are disposable.

The above noted prior art patents disclose dye tubes which have a drawback in that sufficient buckling stability in the axial and radial direction is lacking leading to the danger of damage of the yarn winding layers.

OBJECTS OF THE INVENTION

It is an object of the present invention to provide a molded tubular element serving as a core for textile yarn and received on a dye spindle or the like in a pressurized vessel where dye stuff passes upwardly through the inside of the core and diffuses outwardly through the yarn wound thereon.

Another object of the invention is to provide a substantially rigid dye tube on which textile yarn is wound for dyeing and which is disposable and that, after the element has been wound with yarn and the yarn dyed, can be wound off the tube and the tube discarded.

Still another object of the invention is to provide a dye tube which can be used on all types of winders.

Another object of the present invention is to provide a dye tube of the character described having on the surface thereof carrier elements in the form of stays inclined to the longitudinal axis of the tube, with the first and last stays of a given group being arranged oppositely from the end stays of an adjourning group of stays.

It is another object of the invention to provide a tube of the character described having at each end thereof a region of substantial noncompressibility terminating in an outwardly projecting peripheral rim adapted to fit against an end rim of an adjoining tube placed on the same or another winder.

It is yet another object of the present invention to provide a dye tube which comprises intermediate rings concentrically disposed relative to each other and connected to each other by mean of oppositely extending shaped stays, in order to enhance the inner stability of the structure; the stays being adapted to collapse in the direction of the rings upon severe impact.

A further object of the present invention is to provide a tube carrier whose stability against radial and axial buckling is appreciably increased.

DESCRIPTION OF THE PREFERRED EMBODIMENTS

Figure 2:
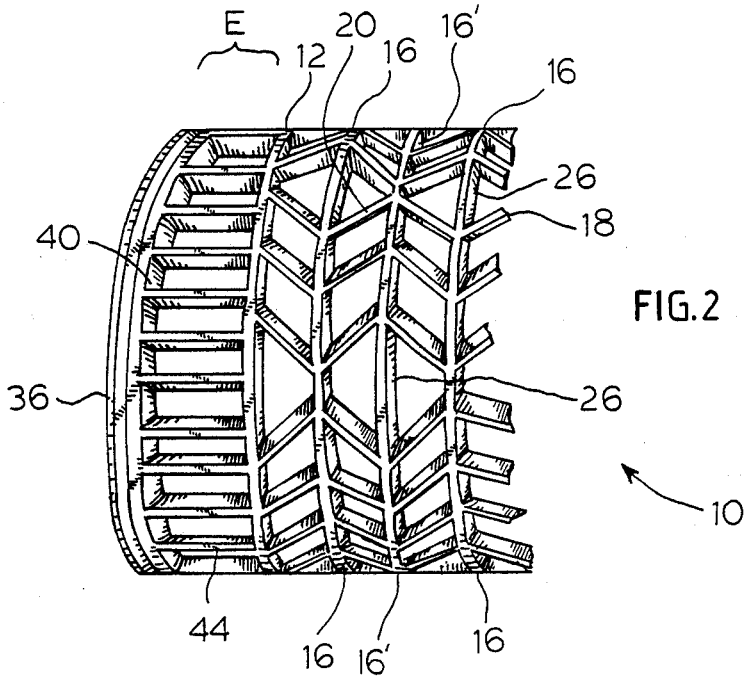
FIG. 2 is a partial side view of the tube shown in FIG. 1.
Figure 3:
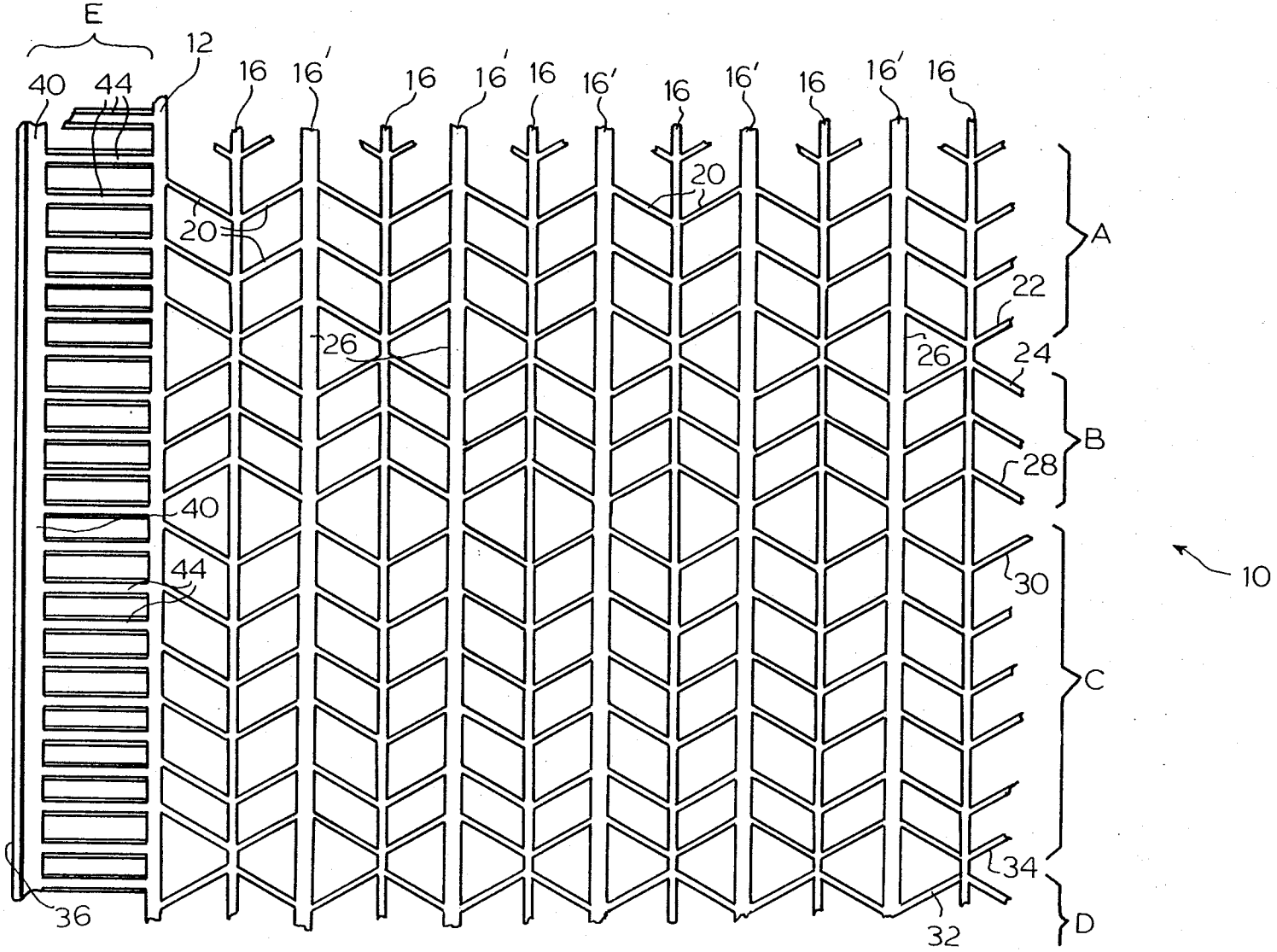
FIG. 3 is a partial side elevational view of the tube according to the present invention and showing details of the end section and of the winding surface.

Referring descriptively to the drawing there is shown and illustrated a molded dye tube constructed in accordance with the principles of the invention and designated by reference character 10, which comprises several interrelated major portions; namely, end rings 12 and 14 concentrically disposed with respect to each other and intermediate rings 16 and 16' also disposed concentrically relative to each other and relative to end rings 12 and 14. Carrier elements in the form of zigzagged ribs 18 extend between the end rings 12 and 14 are supported in the median range by intermediate rings 16'. The ribs 18 can be distributed in groups of equal or unequal numbers along the periphery of the tube 10. The ribs are substantially of the same height as the concentric rings 16 and 16'. It is preferred that alternate rings 16' have the same cross section as end rings 12 and 14 which have a cross section of substantially twice the linear dimensions of rings 16. Ribs 18, as shown more clearly in FIGS. 2 and 3 are about as thick as the thinner rings 16. As shown in FIG. 3, the generally axial ribs 18 are arranged in parallel planes and are of generally wave form in a grouping of four ribs labelled Group A in the upper lefthand part of FIG. 3 (other embodiments may group the ribs in numbers other than four). Ribs 18 are of generally rectangular cross-section. Advantageously, segment 20 of each rib is so dimensioned with respect to portions 26 of the rings as to be able to fold or collapse in that direction upon load or impact.

The last longitudinal rib 22 of Group "A" is spaced from the first longitudinal rib of the next group of ribs labelled "B" in FIG. 3. Ribs in Group "B" also are parallel to one another. It is seen in FIG. 3 that the last rib 22 of Group "A" forms a hexagon (other embodiments may include different polygons other than a hexagon) with the first rib 24 of Group "B". The hexagons are interrupted midway thereof by the portion 26 of the various peripheral rings 16 and 16'. In Group "B" three parallel longitudinal ribs are provided.

In the next group of ribs labelled "C" six parallel ribs are provided. It is seen that the last rib 28 of Group B is aligned oppositely from the first rib 30 of Group C and forms therebetween a hexagon separated by portion 26 of the rings 16 or 16'. This arrangement is repeated about the periphery of the tube 10. Thus part of another group denominated "D" is shown in the lower part of FIG. 3 with its first rib 32 forming a hexagon with the last rib 34 of Group "C", these ribs being aligned oppositely with respect to the last rib of the preceding group of ribs.

Figure 1:
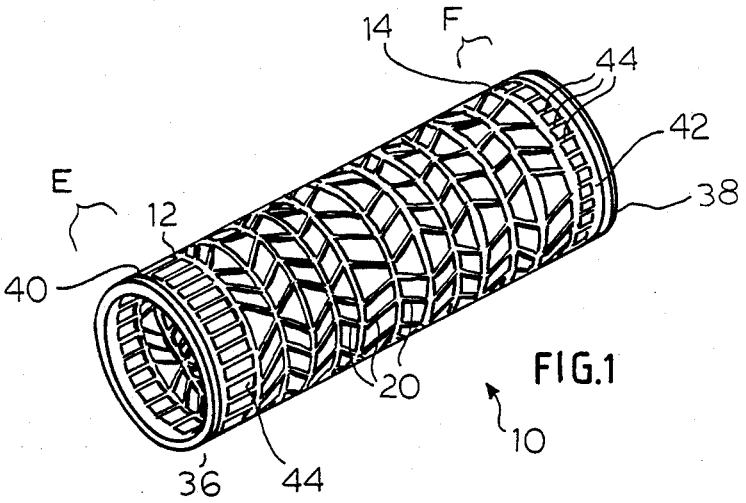
FIG. 1 is an isometric view of a dye tube in accordance with the present invention showing a particular embodiment of the longitudinal stays therein.

In an important feature of the invention, nondeformable torque-resistant zones labelled "E" and "F" (FIG. 1) are provided at each end of the tube 10. These zones "E" and "F" include end rims 36 and 38 which extend outwardly from rings 40 and 42 respectively. The inner end of rings 40 and 42 are connected to the outer end of end rings 12 and 14 respectively by a plurality of parallel, substantially straight, longitudinal ribs 44. These ribs 44 have substantially the same diameter and thickness as the rings 16, but have a triangular cross section with the apex on top. Other embodiments may modify the cross section.

Ribs 18 can be V- or inverted V-shape, with ends of the V-shaped legs in FIG. 3 are connected to adjoining rings 16 and 16'. The upper and lower apex zones of all the ribs 18 are disposed in the same cross-sectional plane and are connected with each other by the rings 16 and 16'.

It will be appreciated that the outer peripheries of all the rings 16 and 16', and rims 36, 38, lie substantially in the same plane. In this manner a large number of tubes 10 can be placed over a winder with rim to rim contact between each tube and the next one without any element thereof protruding beyond that of the next tube.

In zones "E" and "F" the straight ribs 44 connecting rim elements with the last rings are very rigid to provide a zone of substantial noncompressibility.

It is envisioned that the tubular elements of the present invention are disposable. Consequently, in the preferred embodiment they are fabricated by injection molding of a thermoplastic polymeric plastic composition such as, by way of example, polypropylene, "Lexan" carbonate resin or polyethylene.

Preferably the length of segments 20 of the ribs should be about the same as that of portions 26 of rings 16 and 16'. Thus dimensioned, segments 20 can collapse in the direction of portions 26 on impact against the tube and provide added rigidity.

In a successful embodiment of the invention a tube 10 measuring 11 inches was integrally molded from Polypropylene material Its diameter was about 3 inches; Groups A, B, C, D comprised each 3 longitudinal ribs extending for about 9 inches between zones "E" and "F". Rings 16 were about 1/16 inch thick while rings 12, 14 and 16' were about ⅛ inch thick. Zones "E" and "F" were about 1 inch wide. Ribs 44 were about 1/16 inch thick.

While the elements shown have resulted in a tubular structure, those skilled in the art will know that structures of other shapes also can be made by following the concepts of this invention.

The operation and use of the invention herein above described will be evident to those skilled in the art to which it relates from a consideration of the foregoing.

Having described the present invention in detail, it is obvious that one skilled in the art will be able to make variations and modification thereto without departing from the spirit and scope thereof. Accordingly the scope of the present invention should be determined only by the claims appended hereto.

What is claimed is:

1. A dye tube comprising:

a first and a second annular end member;

a plurality of first substantially axial ribs, extending between said first and second annular end members and integrally connected therewith, each having a zig-zag configuration of segments of common length and defining a plurality of apexes;

a plurality of second substantially axial ribs, extending between said first and second annular end members and integrally connected therewith, said second substantially axial ribs differing from said first substantially axial ribs only by having apexes defined by said zig-zag configuration oriented in opposite directions about said dye tube at any given axially determined position on said dye tube;

a plurality of substantially rigid intermediate annular members, each said intermediate annular member integrally connecting said apexes formed by said zig-zag configuration of said first and said second substantially axial ribs at common axially determined positions on said dye tube; and a non-collapsible, torque- and impact-resistant zone, integrally connected to each said first and second annular end members, said zone including a plurality of highly rigid axial members having first ends integrally connected to said annular end members and a second end integrally connected to a peripheral rim.

2. A dye tube as defined in claim 1 wherein said plurality of substantially rigid intermediate annular members having alternating different thicknesses measured axially along said dye tube.

3. The dye tube as defined in claim 1, wherein said first and said second substantially axial ribs have a substantially rectangular cross-section.

4. The dye tube as defined in claim 1, wherein said highly rigid axial members in said non-collapsible, torque- and impact-resistant zone have a generally triangular cross-section.

5. The dye tube as defined in claim 1, wherein said first and said second substantially axial ribs occur in groups of at least one said first substantially axial rib alternating with group of at least one said second substantially axial rib.

* * * * *